US005484377A

United States Patent [19]

Ueda et al.

[11] Patent Number: 5,484,377

[45] Date of Patent: Jan. 16, 1996

[54] CARTON BLANK ERECTOR AND FEEDER

[75] Inventors: Michio Ueda; Seizo Kawamura; Toshio Kanematsu; Masamitsu Mihara; Takayuki Hashimoto, all of Tokushima, Japan

[73] Assignee: Shikoku Kakoki Co., Ltd., Tokushima, Japan

[21] Appl. No.: 171,470

[22] Filed: Dec. 22, 1993

[30] Foreign Application Priority Data

Dec. 25, 1992 [JP] Japan ..... 4-088776 U

[51] Int. Cl.[6] ..... B31B 3/80; B31B 5/78

[52] U.S. Cl. ..... 493/316; 493/313

[58] Field of Search ..... 493/313, 315, 493/316, 317, 309

[56] References Cited

U.S. PATENT DOCUMENTS

| | | | |
|---|---|---|---|
| 3,220,159 | 10/1962 | Killeen | 493/309 |
| 3,249,025 | 5/1966 | Monroe et al. . | |
| 3,987,710 | 10/1976 | Reichert | 493/309 |
| 3,996,843 | 12/1976 | Vogel et al. | 493/309 |
| 5,007,889 | 4/1991 | Wakabayashi et al. | 493/316 |
| 5,162,033 | 11/1992 | Wakabayashi et al. | 493/313 |
| 5,180,355 | 1/1993 | Inoue | 493/316 |
| 5,180,356 | 1/1993 | Wakabayashi et al. | 493/316 |
| 5,298,008 | 3/1994 | Decker et al. | 493/313 |

FOREIGN PATENT DOCUMENTS

| | | |
|---|---|---|
| 0492734 | 12/1991 | European Pat. Off. . |
| 0492744 | 12/1991 | European Pat. Off. . |

*Primary Examiner*—Jack W. Lavinder
*Assistant Examiner*—Christopher W. Day
*Attorney, Agent, or Firm*—Armstrong, Westerman, Hattori, McLeland & Naughton

[57] ABSTRACT

A carton blank erector and feeder comprising a magazine having a delivery opening at one end and accommodating flat blanks as arranged closely side by side from the end toward the other end thereof, the delivery opening being so positioned as to be opposed to a phantom outward extension of a bottom forming mandrel as stopped at a feed station, transport means for withdrawing the blank from the delivery opening and transporting the blank to the outward extension, and means for unfolding the blank from the flat form to a tubular form of square cross section while the blank is being transported by the transport means. The unfolding means has at least two unfolding claws provided at edge portions of the opening so as to be engageable respectively with opposite ends of the blank to be withdrawn from the opening, and at least two unfolding ensuring claws arranged at an intermediate portion of the path of transport of the blank so as to be engageable with the respective blank ends after the blank ends are released from the unfolding claws.

4 Claims, 8 Drawing Sheets

CARTON BLANK ERECTOR AND FEEDER

BACKGROUND OF THE INVENTION

The present invention relates to a device for feeding blanks, for example, for containers to be filled with milk, and more particularly to a blank feeder for use with blanks folded flat so as to be unfoldable to a tubular form of square to rectangular cross section to feed each of the blanks to a bottom forming mandrel as stopped at a feed station by unfolding the blank to the tubular form and fitting the unfolded blank around the mandrel.

Feeders of the type mentioned above are already known which comprise a magazine having a delivery opening at one end and accommodating flat blanks as arranged closely side by side from this end toward the other end thereof, a transport arm for withdrawing the blank from the delivery opening and transporting the blank to a phantom extension of a mandrel, and means for unfolding the blank from the flat form to a tubular form of square cross section while the blank is being transported by the arm, the unfolding means having two unfolding claws provided at edge portions of the delivery opening so as to be engageable respectively with opposite ends of the blank to be withdrawn from the delivery opening.

With the conventional device described, the unfolding claws fail to fully unfold the blank and are likely to permit the blank as unfolded once an expanded state to restore itself to the original flat form during transport.

SUMMARY OF THE INVENTION

An object of the present invention is to provide a blank feeder adapted to reliably unfold blanks from a flat form to a tubular form of square to rectangular cross section.

The present invention provides a blank feeder for use with blanks which are folded flat so as to be unfoldable to a tubular form of square to rectangular cross section for feeding each of the blanks to a bottom forming mandrel as stopped at a feed station by unfolding the blank to the tubular form and fitting the unfolded blank around the mandrel. The blank feeder comprises a magazine having a delivery opening at one end and accommodating flat blanks as arranged closely side by side from the end toward the other end thereof, the delivery opening being so positioned as to be opposed to a phantom outward extension of the mandrel, transport means for withdrawing the blank from the delivery opening and transporting the blank to the outward extension, and means for unfolding the blank from the flat form to the tubular form while the blank is being transported by the transport means, the unfolding means having at least two unfolding claws provided at edge portions of the delivery opening so as to be engageable respectively with opposite ends of the blank to be withdrawn from the delivery opening, and at least two unfolding ensuring claws arranged at an intermediate portion of the path of transport of the blank so as to be engageable with the respective blank ends after the blank ends are released from the unfolding claws.

With the blank feeder of the present invention, the unfolding means has the unfolding ensuring claws arranged at an intermediate portion of the path of transport of the blank and engageable with the respective blank ends after the blank ends have been released from the unfolding claws, so that the unfolding ensuring claws unfold the blank to a greater extent even if the blank tends to restore itself to the original flat state during transport. This ensures that the blank will be unfolded from the flat form to the tubular form reliably.

DESCRIPTION OF THE PREFERRED EMBODIMENT

An embodiment of the present invention will be described below with reference to the drawings.

Figure 8:
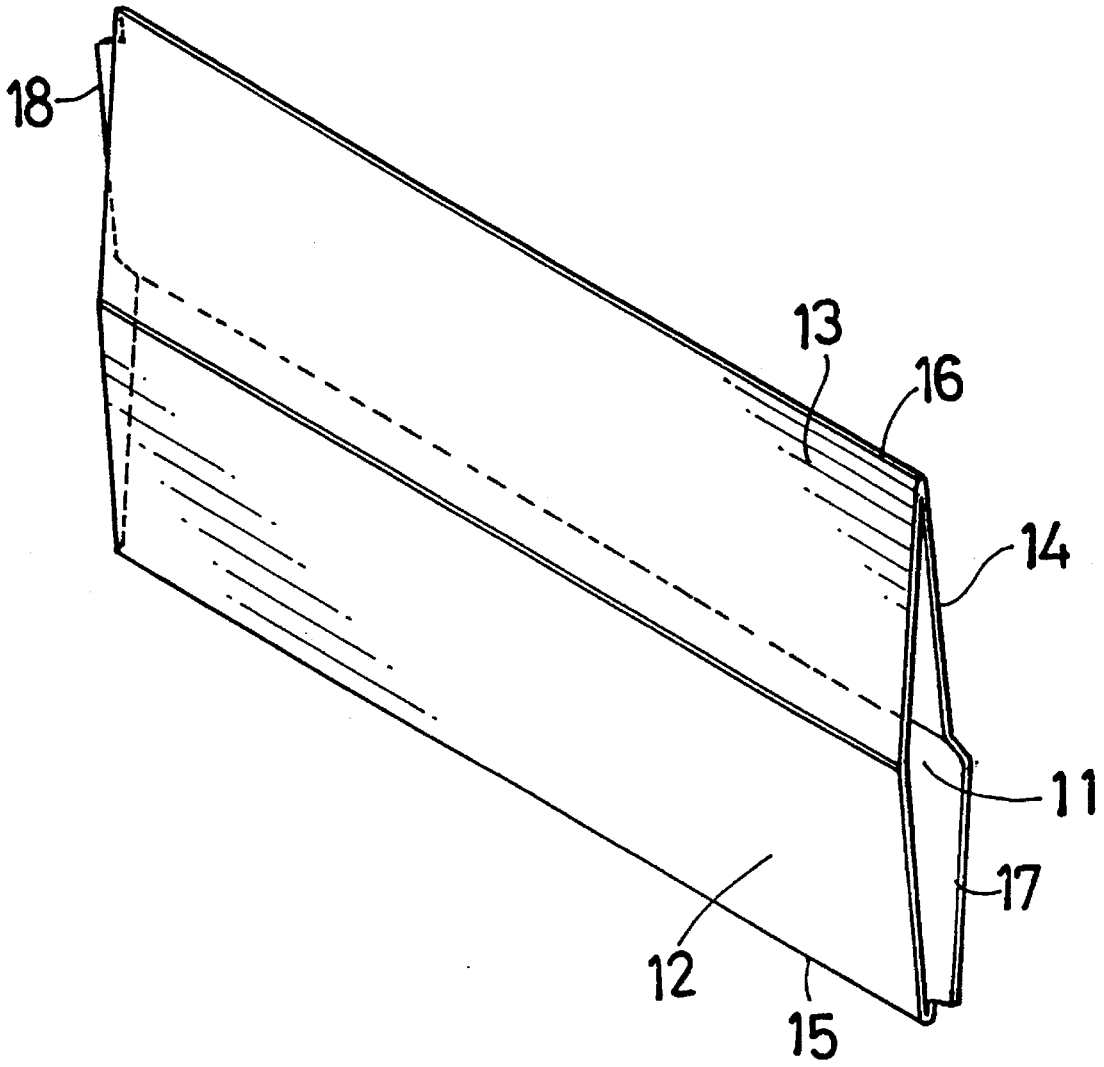
FIG. 8 is a perspective view of a blank for use with the feeder.

FIG. 8 shows a blank which has first to fourth side wall panels 11 to 14 continuous with one another endlessly. The blank is folded flat so as to be unfoldable to a tubular form of rectangular or square cross section by being folded along a first score 15 between the first side wall panel 11 and the second side wall panel 12 and along a second score 16 between the third side wall panel 13 and the fourth side wall panel 14. At one end of the blank, the first side wall panel 11 has a first engageable portion 17 extending outward from the corresponding end thereof beyond the adjacent end of the second side wall panel 12, and at the other end of the blank, the fourth side wall panel 14 has a second engageable portion 18 extending outward from the corresponding end thereof beyond the adjacent end of the third side wall panel 13.

Figure 1:
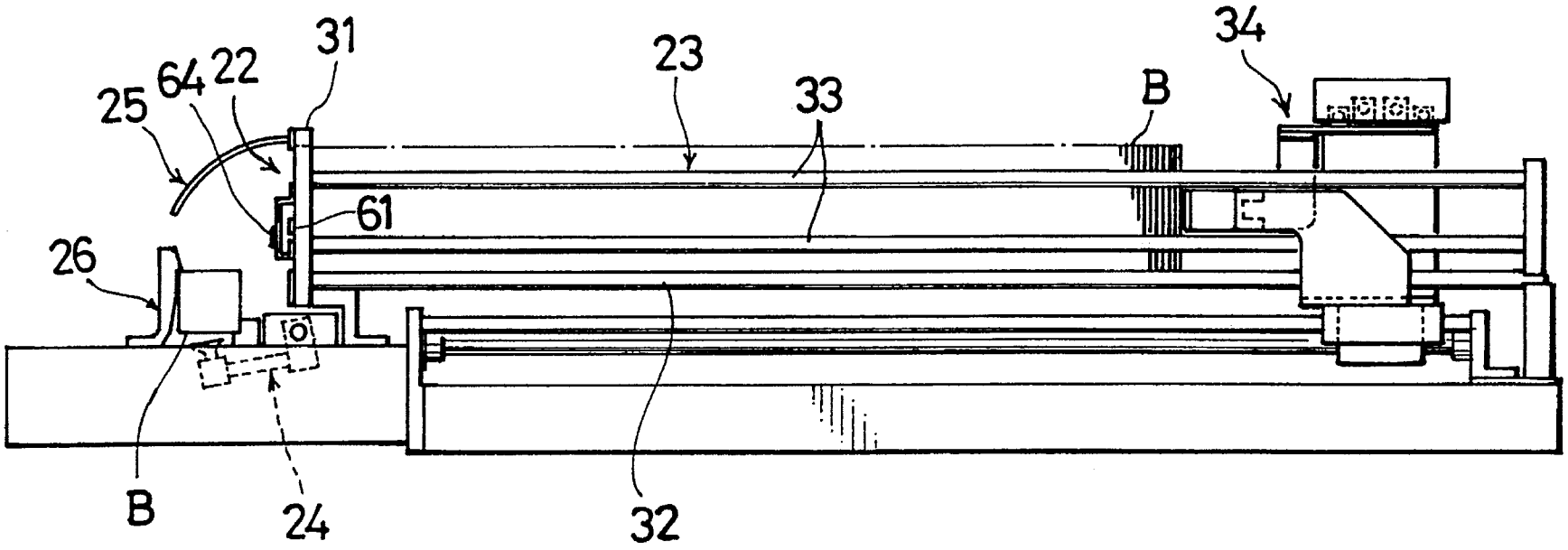
FIG. 1 is a side elevation of a feeder embodying the invention.
Figure 2:
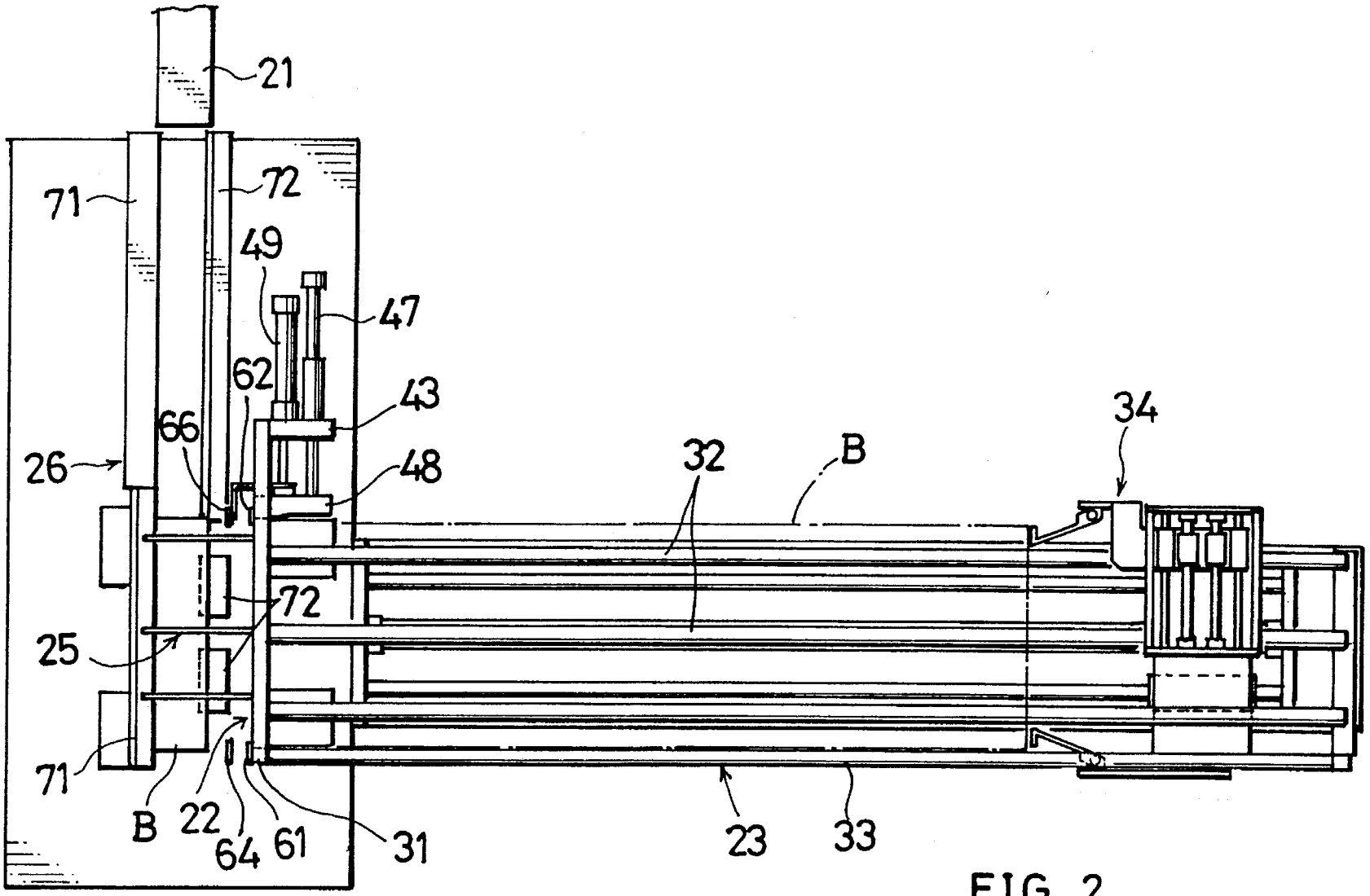
FIG. 2 is a plan view of the feeder.
Figure 3:
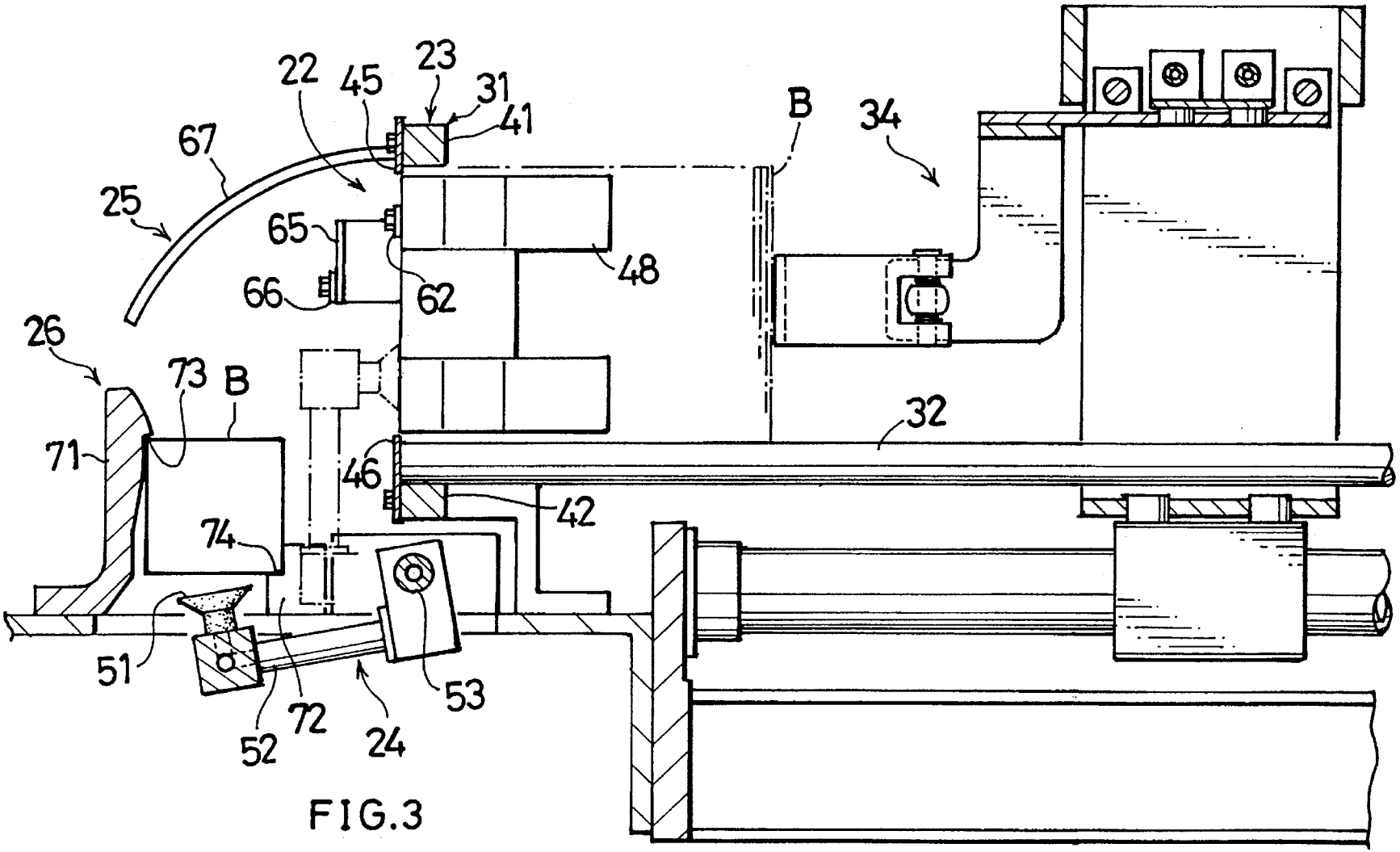
FIG. 3 is an enlarged fragmentary longitudinal view in vertical section of the feeder.
Figure 4:
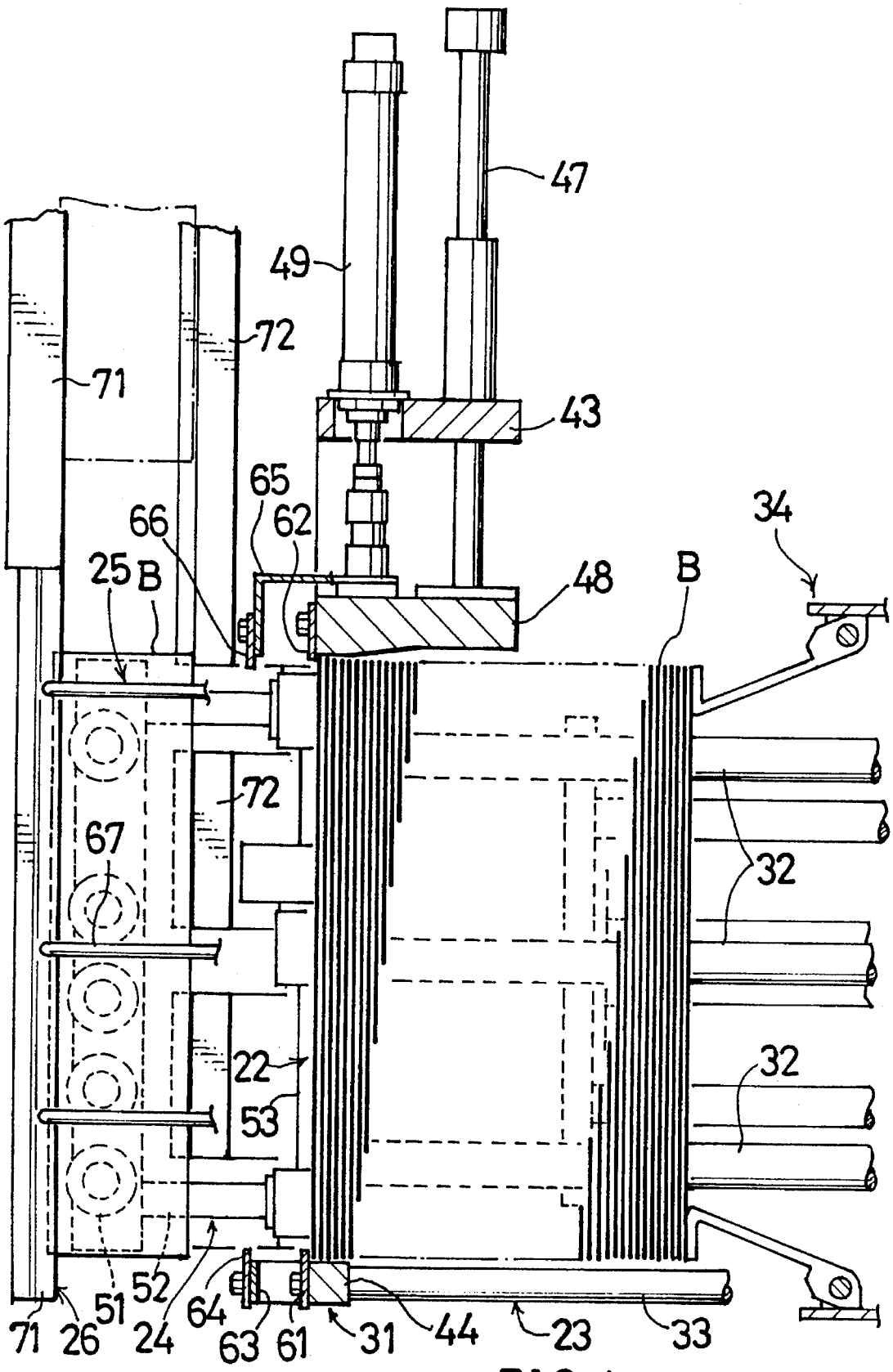
FIG. 4 is an enlarged fragmentary view in horizontal section of the feeder.
Figure 5:
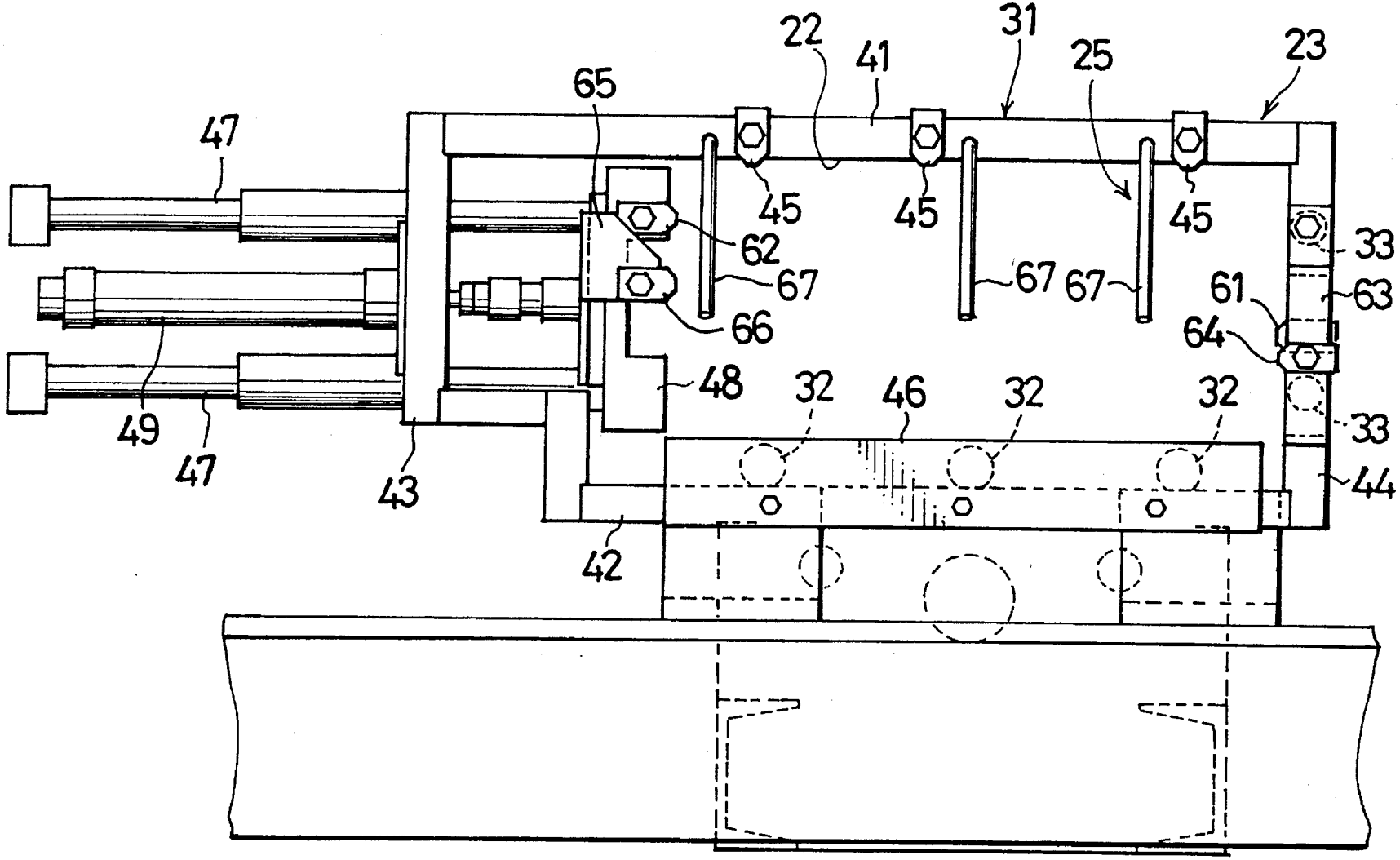
FIG. 5 is a front view of a magazine in the feeder.
Figure 6:
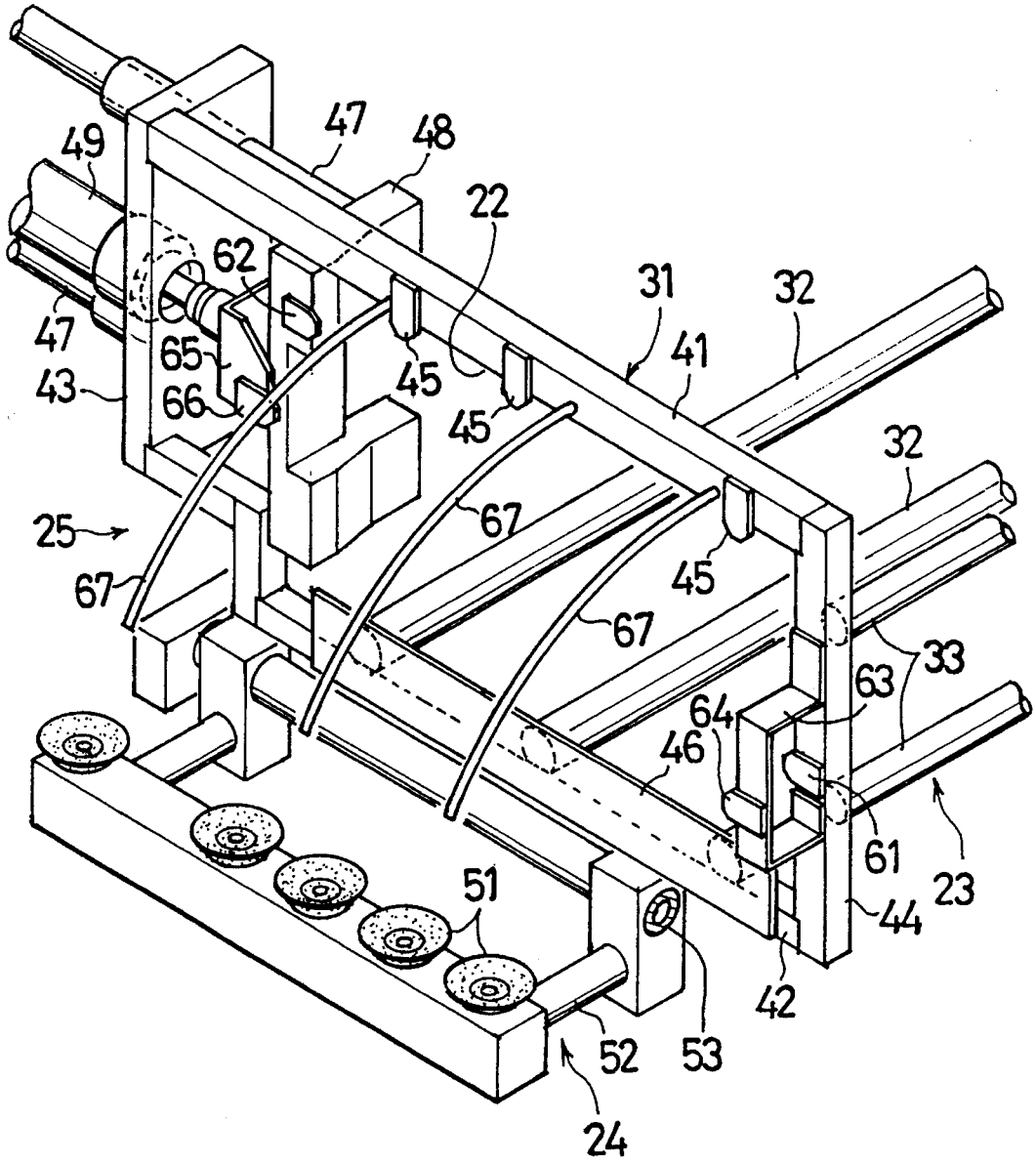
FIG. 6 is a perspective view of the magazine.

FIGS. 1 and 2 show a blank feeder, which comprises a magazine 23 disposed at one side of a phantom outward extension of a bottom forming mandrel 21 extending outward and stopped at a feed station, the magazine 23 having a delivery opening 22 at its left end, facing to the left and accommodating flat blanks B as arranged closely side by side from the left end toward the right end of the magazine; transport means 24 for delivering each of the blanks B from the delivery opening 22 and transporting the blank to the outward extension; means 25 for unfolding the blank B from the flat form to the tubular form of square cross section while the blank is being transported by the transport means 24; a holder 25 for holding the tubular blank B on the outward extension; and a loader (not shown) for fitting the blank B held by the holder 26 around the mandrel 21.

Within the magazine 23, the blanks B are so arranged in a row that the second and third side wall panels 12, 13 of each blank face toward the delivery opening 22 with the panel 12 positioned below the panel 13 (in the state shown in FIG. 8).

As shown in greater detail in FIGS. 3 to 6, the magazine 23 comprises a vertical rectangular frame 31 defining the delivery opening 22, and a plurality of kinds of guide rails 32, 33 extending rightward from required portions of the frame 31. The magazine 23 further has a pressing device 34 for moving the blanks B toward the opening 23 inside the magazine 23.

The frame 31 comprises an upper frame member 41, lower frame member 42, inner frame member 43 and outer frame member 44. The upper frame member 41 is provided with a plurality of retaining pieces 45 for the portion of the second score 16 of the blank B to bear on. The lower frame member 42 is provided with a striplike retaining plate 46 for the portion of the blank first score 15 to bear on. The inner frame member 43 has a pair of upper and lower horizontal slide rods 47 extending therethrough transversely of the magazine. The rods 47 have outer ends to which a movable frame member 48 is attached. A hydraulic cylinder 49 attached to the inner frame member 43 and directed outward has a rod connected to the movable frame member 48.

The position of the movable frame member 48 is adjusted in accordance with the length of the blanks to be supplied, by the operation of the hydraulic cylinder 49.

The transport means 24 comprises a suction member 51, a pair of transport arms 52 having the suction member 51 attached to their forward ends and a rotatable shaft 53 having fixed thereto the base ends of the transport arms 52. The rotatable shaft 53 extends in parallel to the phantom outward extension of the mandrel 21 and is disposed below the delivery opening 22 so that the second side wall panel 12 of the blank B in the opening 22 can be attracted to the suction member 51.

The unfolding means 25 comprises a first unfolding claw 61 attached to the outer frame member 44 at a position closer to its lower end than the midportion of the height thereof so as to be engageable with the first engageable portion 17 of the blank B in the the delivery opening 22, a second unfolding claw 62 attached to the movable frame member 48 at a position closer to its upper end than the midportion of the height thereof so as to be engageable with the second engageable portion 18 of the blank B, a first unfolding ensuring claw 64 attached to the outer frame member 44 by a bracket 63 and positioned at the left of the first unfolding claw 61 obliquely therebelow, a second unfolding ensuring claw 66 attached to the movable frame member 48 by a bracket 65 and positioned at the left of the second unfolding claw 62 obliquely therebelow, and a plurality of bent guides 67 each in the form of a circular-arc rod and extending from required portions of the upper frame member 41 toward the holder 26.

The holder 26 comprises a pair of guide rails 71, 72 extending on opposite sides of and in parallel to the outward extension of the mandrel. The guide rails 71, 72 are formed with recesses 73, 74, respectively, as opposed to each other for opposed corners of the tubular blank B to fit in.

The blank B is unfolded in the manner to be described below with reference to FIG. 7, which shows the second unfolding claw 62 and the second unfolding ensuring claw 66 only. The first unfolding claw 61 and the first unfolding ensuring claw 64, although not illustrated in FIG. 7, act substantially in the same manner as the second unfolding claw 62 and the second unfolding ensuring claw 66, the unfolding action of which will be described below.

Figures 7A, 7B, 7C:
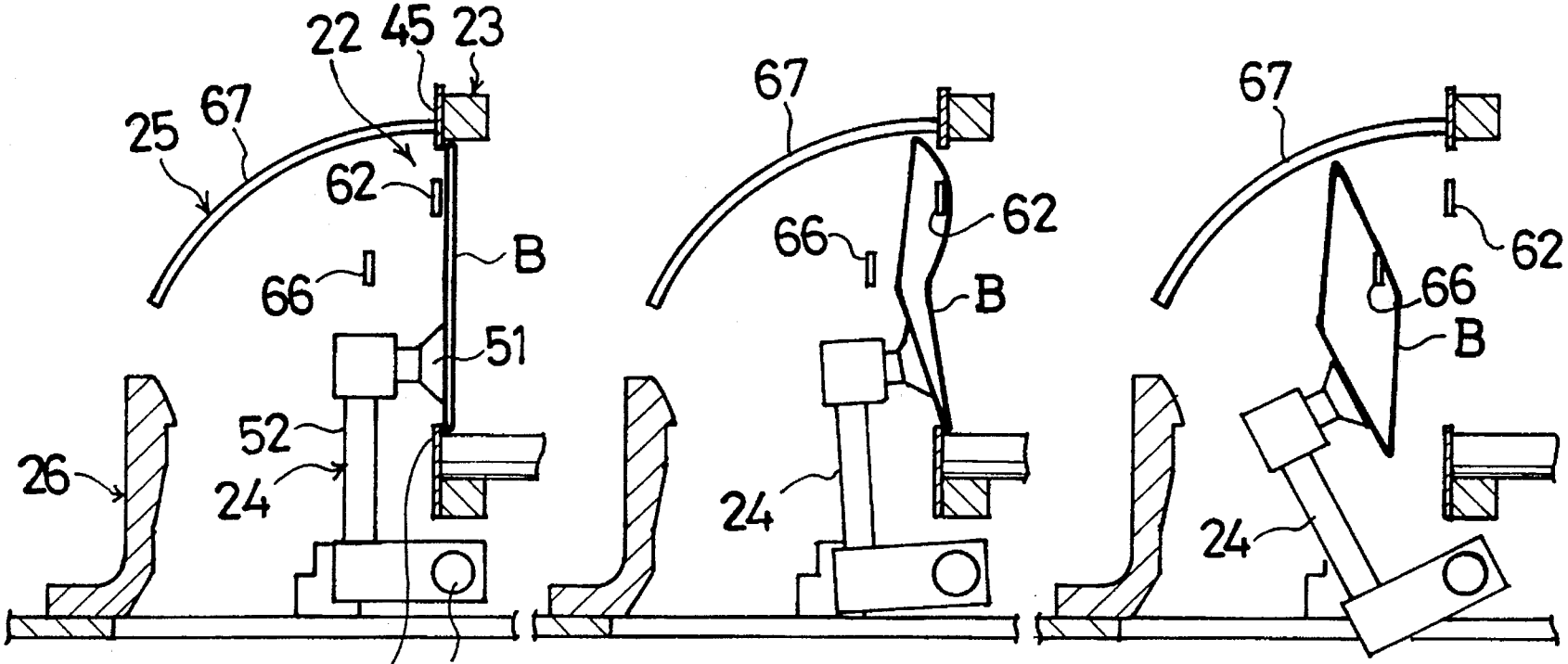
FIG. 7 includes diagrams for illustrating an unfolding operation of the feeder.

The transport arms 52 are raised to an upright position, causing the suction member 51 to attract thereto the second side wall panel 12 of the blank B in the delivery opening 22 (FIG. 7, (a)). When the arms 52 are slightly inclined from this state, the upper edge portion of the blank B is released from the retaining pieces 45, and at the same time, the second engageable portion 18 is engaged by the unfolding claw 62, whereby the blank B is slightly opened (FIG. 7, (b)). When the transport arms 52 are further inclined, the lower edge portion of the blank B is released from the retaining plate 46, and approximately at this time, the engageable portion 18 is brought out of engagement with the unfolding claw 62. The upper edge portion of the blank B then comes into contact with the bent guides 67, but before the disengagement, the engageable portion 18 is engaged by the unfolding ensuring claw 66, whereby the unfolded blank B is unfolded to a greater extent (FIG. 7, (c)). The blank B is now unlikely to restore itself to the original flat form, and subsequently guided to the holder 26 by the bent guides 67 while being unfolded to a tubular form of square cross section.

What is claimed is:

1. A carton blank erector and feeder for unfolding a folded flat blank into a square or rectangular cross sectional tube, then feeding each of the unfolded blanks to a bottom forming mandrel and fitting the unfolded blank around the mandrel, said carton blank erector and feeder comprising:

a magazine having a delivery opening at one end and accommodating flat blanks as arranged closely side by side from said one delivery opening end toward a second end thereof;

transport means for withdrawing the blank from the delivery opening and transporting the blank along a path to a guide rail which is in alignment with the bottom forming mandrel; and means for unfolding the blank while the blank is being transported by the transport means, the unfolding means having at least two unfolding claws provided at edge portions of the delivery opening so as to be engageable with opposite ends of the blank to be withdrawn from the delivery opening, and at least two unfolding ensuring claws arranged downstream of the unfolding claws at an intermediate portion of the path so as to be engageable with the respective blank ends after the blank ends are released from the unfolding claws.

2. The carton blank erector and feeder as defined in claim 1, wherein the magazine has a frame defining the delivery opening and comprising upper and lower frame members extending longitudinally of the blanks accommodated in the magazine, and inner and outer frame members each interconnecting the ends of the frame members at the same side, the unfolding claws being attached directly at least to the respective inner and outer frame members, the unfolding ensuring claws being attached at least to the respective inner and outer frame members by a bracket.

3. The carton blank erector and feeder as defined in claim 1, wherein the transport means comprises a suction member, transport arms having the suction member attached to forward ends thereof, and a rotatable shaft having fixed thereto base ends of the transport arms and extending longitudinally of the blanks accommodated in the magazine.

4. The carton blank erector and feeder as defined in claim 1, wherein a holder is provided for holding the tubular blank while transporting the blank to the mandrel, and the unfolding means has bent guides for guiding an upper folded edge portion of the blank from the delivery opening to the holder while the blank is being transported by the transport means.

* * * * *